US007228574B2

(12) United States Patent
Hansen et al.

(10) Patent No.: US 7,228,574 B2
(45) Date of Patent: Jun. 12, 2007

(54) WASH BASIN COMPRISING AN ILLUMINATING DEVICE

(75) Inventors: Lars Hansen, Seeheim (DE); Ingo Irmler, Griesheim (DE)

(73) Assignee: Wella AG, Darmstadt (DE)

( * ) Notice: Subject to any disclaimer, the term of this patent is extended or adjusted under 35 U.S.C. 154(b) by 137 days.

(21) Appl. No.: 10/492,700

(22) PCT Filed: Oct. 18, 2002

(86) PCT No.: PCT/EP02/11702

§ 371 (c)(1),
(2), (4) Date: Sep. 9, 2004

(87) PCT Pub. No.: WO03/034883

PCT Pub. Date: May 1, 2003

(65) Prior Publication Data

US 2005/0015873 A1 Jan. 27, 2005

(30) Foreign Application Priority Data

Oct. 18, 2001 (DE) ..... 101 51 499

(51) Int. Cl.
*A47K 1/04* (2006.01)

(52) U.S. Cl. ..... 4/619; 4/638; 4/654

(58) Field of Classification Search ..... 4/538, 4/619, 638
See application file for complete search history.

(56) References Cited

U.S. PATENT DOCUMENTS

| | | | | |
|---|---|---|---|---|
| 4,535,489 | A | 8/1985 | Elkins | |
| 4,875,958 | A * | 10/1989 | Kurokawa | 156/108 |
| 6,279,179 | B1 * | 8/2001 | Register | 4/623 |
| D455,476 | S * | 4/2002 | Ferrer Beltran | D23/293.1 |
| 6,601,247 | B2 * | 8/2003 | Shimizu | 4/584 |
| 6,957,452 | B2 * | 10/2005 | Grant | 4/638 |

FOREIGN PATENT DOCUMENTS

| | | |
|---|---|---|
| DE | 201 05 708 U | 7/2001 |
| WO | 01 73227 A | 10/2001 |

* cited by examiner

*Primary Examiner*—Charles E. Phillips
(74) *Attorney, Agent, or Firm*—Michael J. Striker

(57) ABSTRACT

The invention relates to a wash basin (2) for rinsing or washing hair of the head, comprising an illuminating device (3) having a plurality of light projectors (5) for illuminating an inner region (14) of the wash basin (2). Said wash basin (2) consists of a light permeable material (4), the light projectors (5) of the illuminating device (3) being arranged outside the wash basin (2) in such a way that at least one partial region (11) of an outer side (6) of the wash basin (2) can be subjected to light (12).

10 Claims, 2 Drawing Sheets

WASH BASIN COMPRISING AN ILLUMINATING DEVICE

CROSS-REFERENCE

The invention described and claimed hereinbelow is also described in PCT/EP 02/11702, filed Oct. 18, 2002 and DE 101 51 499.9, filed Oct. 18, 2001. This German Patent Application, whose subject matter is incorporated here by reference, provides the basis for a claim of priority of invention under 35 U.S.C. 119 (a)-(d).

BACKGROUND OF THE INVENTION

The invention relates to wash basins for rinsing or washing hair, in which an illuminating device with a plurality of light emitters is provided for lighting the interior of the wash basin.

One such wash basin with an illuminating device is known from German Utility Model DE 201 05 708 U1, in which a plurality of light emitters are let into the wash basin for illuminating the interior of the wash basin. The purpose of this provision is to avoid the effect of conventional lighting in a hairdressing salon, where the typically poor lighting conditions lead to shadows on the back of the head, making it more difficult to rinse or wash the hair properly, because it is hard to tell whether all the residues of the rinsing agent or shampoo have been rinsed or washed out of the hair. For letting the light emitters into the wash basin, suitable bores through a wall of the basin are necessary and have to be manually secured in watertight fashion, which is very complicated. Moreover, because the light emitters are located at a distance from one another, the back of the head is not evenly lighted.

SUMMARY OF THE INVENTION

The object of the invention is to create a wash basin of this generic type that does not require any bores through the wall of the basin, does not necessitate manually providing a watertight fastening retroactively for the light emitters, and achieves more-uniform lighting of the back of the head.

BRIEF DESCRIPTION OF THE DRAWINGS

The invention will be described in further detail in terms of an exemplary embodiment.

Shown are.

DETAILED DESCRIPTION OF THE PREFERRED EMBODIMENTS

Figure 1:
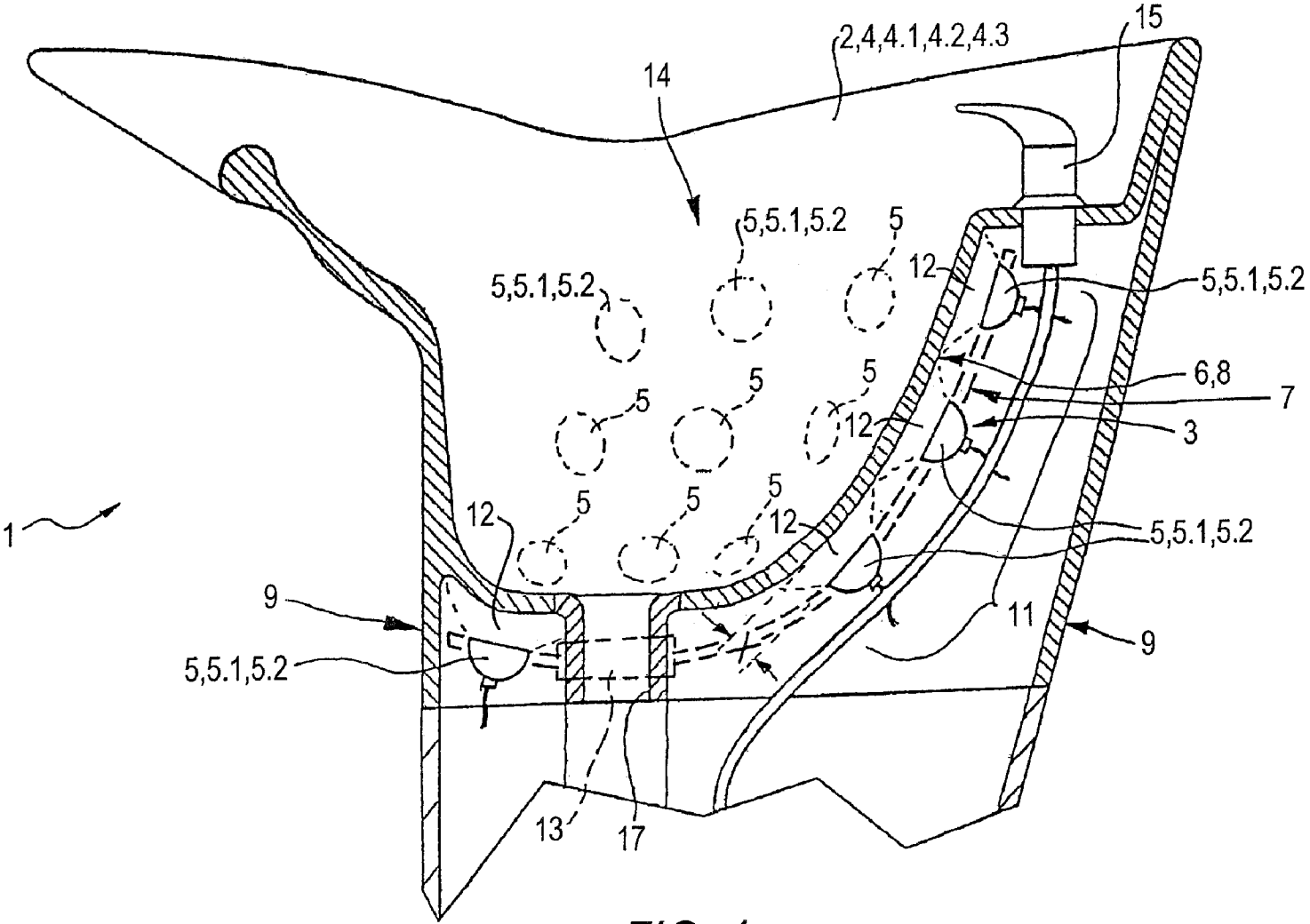
FIG. 1, in a sectional side view, a wash basin with an illuminating device.
Figure 2:
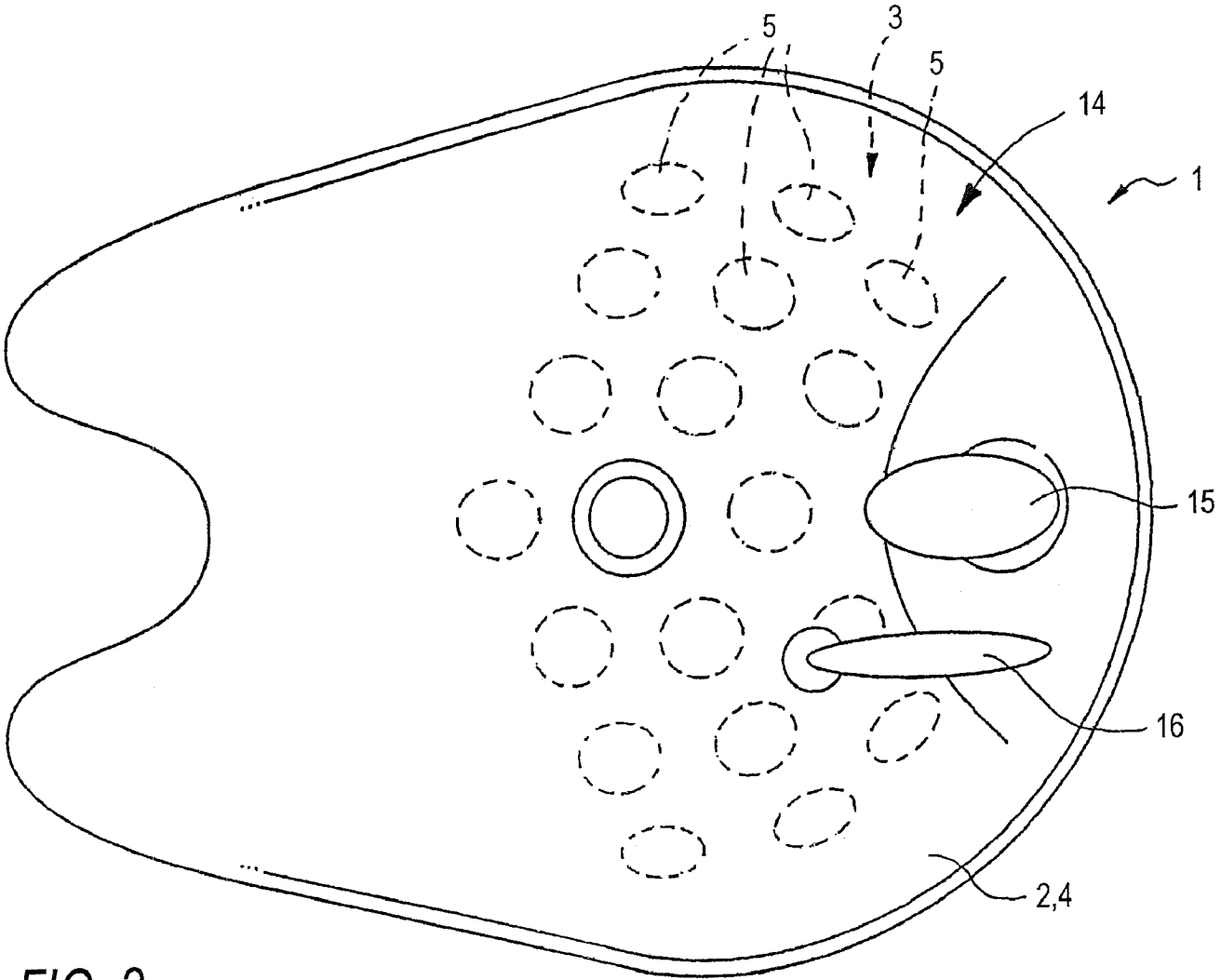
FIG. 2, in a plan view, the wash basin of FIG. 1.

FIG. 1 shows a wash basin for rinsing or washing hair; an illuminating device 3 with a plurality of light emitters 5 is provided for illuminating the interior 14 of the wash basin 2. The wash basin 2, which is provided with a faucet 15 and a handheld spray attachment 16, comprises a transparent material 4, and the light emitters 5 of the illuminating device 3 are disposed outside the wash basin 2 in such a way that at least one region 11 of an outside 6 of the wash basin 2 can be acted upon by light 12. As the material 4, glass 4.1 or plastic 4.2 is selectively provided, which for the sake of pronounced light scattering can comprise opaque material 4.3. However, for the sake of pronounced light scattering, the outside 6 can also be provided with a matting 8. Economical production and installation of the light emitters 5 is attained by providing that the light emitters 5 are combined into a structural unit 7, and with suitable connections among one another, the light emitters 5 form a basketlike structure as the structural unit 7. The structural unit 7 is connected on the outside to a drainpipe 17 by means of a connecting part 13, for example. For the sake of mechanical protection of the light emitters 5 and optionally for protection against glare as well, it is provided that the light emitters 5 have an outer lining 9.

As the light emitters 5, light-emitting diodes 5.1 or low-voltage halogen lamps 5.2—preferably emitting white light—can be provided. The wash basin 2 can be provided in the form of a rear-facing wash basin 10, which can be embodied to make a rear-facing washing system 1. It can be provided that the outer lining 9 and the wash basin 2 are made together in one piece from the transparent material 4.

LIST OF REFERENCE NUMERALS

1 Rear-facing washing system
2 Wash basin
3 Illuminating device
4 Transparent material
4.1 Glass
4.2 Plastic
4.3 Opaque material
5 Light emitter
5.1 Light-emitting diode
5.2 low-voltage halogen lamp
6 Outside
7 Structural unit
8 Matting
9 Lining
10 Rear-facing wash basin
11 Region
12 Light
13 Connecting part
14 Interior
15 Faucet
16 Handheld spray attachment
17 Drainpipe
x Spacing

The invention claimed is:

1. A wash basin for rinsing or washing hair, comprising:
a transparent material (4);
a drainpipe (17); and
a basket-shaped structural unit (7) comprising a connecting part (13) and a plurality of interconnected light emitters (5);
wherein the structural unit (7) is connected to the outside of the drainpipe (17) by means of the connecting part (13) so that the light emitters (5) are arranged around the wash basin so that at least one region (11) of the wash basin is acted on by light from the light emitters (5).

2. The wash basin of claim 1, wherein as the material (4), selectively glass (4.1) or plastic (4.2) is provided.

3. The wash basin of claim 1, wherein an opaque material (4.3) is provided.

4. The wash basin of claim 1, wherein the outside (6) is provided with a matting (8).

5. The wash basin of claim 1, wherein the light emitters (5) are combined into a structural unit (7).

6. The wash basin of claim 1, wherein the light emitters (5) are provided with an outer lining (9).

7. The wash basin of claim 1, wherein the light emitters (5) have a light-emitting diode (5.1) or a low-voltage halogen lamp (5.2).

8. The wash basin of claim 1, wherein the wash basin (2) is provided in the form of a rear-facing wash basin (10).

9. The wash basin of claim 8, wherein the rear-facing wash basin (10) is embodied as a rear-facing washing system (1).

10. The wash basin of claim 6, wherein the outer lining (9) and the wash basin (2) are made together in one piece from the transparent material (4).

* * * * *